US006241298B1

(12) United States Patent
Whyte et al.

(10) Patent No.: US 6,241,298 B1
(45) Date of Patent: Jun. 5, 2001

(54) RELEASE MECHANISM

(75) Inventors: Ronald Norris Whyte, Aberdeen; David Stewart Hamilton, Stonehaven, both of (GB)

(73) Assignee: Easylift Limited, Aberdeen (GB)

( * ) Notice: Subject to any disclaimer, the term of this patent is extended or adjusted under 35 U.S.C. 154(b) by 0 days.

(21) Appl. No.: 09/367,638

(22) PCT Filed: Feb. 18, 1998

(86) PCT No.: PCT/GB98/00502

§ 371 Date: Aug. 18, 1999

§ 102(e) Date: Aug. 18, 1999

(87) PCT Pub. No.: WO98/37009

PCT Pub. Date: Aug. 27, 1998

(30) Foreign Application Priority Data

Feb. 18, 1997 (GB) ..... 9703426

(51) Int. Cl.[7] ..... B66C 1/34

(52) U.S. Cl. ..... 294/82.36; 294/82.3; 294/88; 294/905

(58) Field of Search ..... 294/75, 81.56, 294/82.11, 82.15, 82.16, 82.24, 82.27, 82.3, 82.31, 82.36, 905

(56) References Cited

U.S. PATENT DOCUMENTS

| | | | | |
|---|---|---|---|---|
| 1,576,197 | | 3/1926 | Kuffel et al. . | |
| 2,174,911 | | 10/1939 | Stevenson . | |
| 2,370,528 | * | 2/1945 | Fontaine | 294/88 |
| 2,603,524 | | 7/1952 | Amelung . | |
| 2,998,277 | * | 8/1961 | Himel | 294/75 |
| 3,259,419 | | 7/1966 | Schwarzbach . | |
| 3,310,335 | * | 3/1967 | Shuey | 294/88 |
| 3,401,739 | * | 9/1968 | Opletal | 294/88 X |
| 3,633,960 | | 1/1972 | Drayton . | |
| 3,918,758 | | 11/1975 | Fournier . | |
| 3,984,900 | | 10/1976 | Cirelli . | |
| 4,416,480 | | 11/1983 | Moody . | |
| 4,664,559 | | 5/1987 | Berrang . | |
| 5,178,427 | | 1/1993 | Jorritsma . | |

FOREIGN PATENT DOCUMENTS

| | | |
|---|---|---|
| 107269 | 10/1924 | (CH) . |
| 1184696 | 3/1970 | (GB) . |
| 1464319 | 2/1977 | (GB) . |
| 2293407 | 3/1996 | (GB) . |
| 578257 | 10/1977 | (SU) . |
| 659506 | 4/1979 | (SU) . |
| 1477647 | 5/1989 | (SU) . |
| 86/07582 | 12/1986 | (WO) . |

* cited by examiner

*Primary Examiner*—Johnny D. Cherry
(74) *Attorney, Agent, or Firm*—Venabler; Gabor J. Kelemen

(57) ABSTRACT

The present invention relates to a release mechanism (1) for use in supporting a load (6) from a crane. The release mechanism (1) comprises a remotely operable release hook (2) for supporting by a cable (4) a load (6). The hook (2) is provided with an ejector lever (8) for releasing the cable from the hook (6) upon actuation of the ejection lever (8). Connected above the hook (2) by a cable link (10) is a control unit (12) arranged for controlling the ejector lever (8) on the hook (2). The control unit (12) and the ejector lever (8) are connected together by a communication cable (14) carrying pressurised hydraulic fluid. The control unit and the hook are substantially spaced apart.

20 Claims, 3 Drawing Sheets

RELEASE MECHANISM

The present invention relates to a release mechanism suitable for use with lift or crane hooks but not exclusively. The invention relates also to a hook for use with the release mechanism and to a control system for use therewith.

Release mechanisms for use with crane hooks and the like are generally well known. There are essentially two different types of release mechanism for use with hooks—the self-releasing type arranged for automatically releasing the load on a hook upon deposition of the load on the ground and manually operable release mechanisms which release a load only upon being activated by an operator. The former automatically releasing mechanisms have the disadvantage that they release a load as soon as it is placed on the ground and thus for example, if the load is in the wrong place, it has to be placed back onto the crane hook before it can be moved. This is time consuming and in certain conditions, for example off-shore drilling operations, potentially very dangerous to operators. Such automatically releasing mechanisms are known from DE Patent No. 2757321, FR Patent No. 2411795, SU Patent No. 578257, International Publication No. WO 86/07582 and U.S. Pat. No. 5,178,427.

The latter type of release mechanism which are frequently arranged for remote operation have the advantage over automatically releasing mechanisms that they will only release a load when instructed to do so by an operator and thereby avoid unintentional disconnection. UK Patent Publication No. 2293407A discloses a crane hook having a remotely controlled ejection lever. A particular disadvantage of the release mechanism disclosed therein is that there is required a more or less large shank housing to house a motor; an hydraulic pump driven by said motor; a power supply for said motor; an hydraulic cylinder/ram driven by the hydraulic pump and the various control circuitry for the remote operation of the ejection lever portion of the hook. Both types of release mechanism might typically be approximately 1 m in length and lm in diameter and weigh 565 kg and do not lend themselves to use in off-shore oil and gas exploration applications as it will be appreciated that such a large and heavy hook may swing about and result in damage under adverse weather and other operating conditions to installations and personnel securing a load to be carried by the hook.

Furthermore, conventional known hooks are generally in the form of more or less large cast or forged one-piece bodies containing an ejection lever. One disadvantage of such one-piece bodies is that they are not possible to repair insofar as they cannot be disassembled. Furthermore, the arrangement by which the ejector lever is operated, i.e. a hydraulic ram together with the one-piece construction, means that such hooks are generally large with the hydraulic ram mounted externally as in GB 2293407A.

Additionally, such one-piece hooks which have a centrally mounted ejection lever cannot meet increasingly stringent national, regional and international standards in, for example, the United Kingdom and De Norsk Veritas rules relating to offset loading. Offset loading is where one may have different loadings on the hook on each side of the centrally mounted ejection lever due to a load not being lifted centrally or by the load swinging as may happen in use on off-shore application.

It is an object of the present invention to avoid or minimise one or more of the foregoing disadvantages.

In a first respect the present invention provides a release mechanism suitable for use in releasing remotely a load supported on a hook or the like which mechanism comprises a discrete load supporting means provided with ejector means formed and arranged for selectively ejecting a said load supported thereby and discrete control means formed and arranged for controlling said ejector means on said load supporting means; characterised in that said load supporting means is substantially spaced apart and depends from said control means by an elongate support link and said control means and said ejector means are connected together by a communication means whereby in use a load may be secured to said load supporting means by an operator with said control means of the release mechanism substantially remote from said operator.

Thus, with a release mechanism according to the present invention a load may be secured thereto in a substantially safer way than previous designs of automatic and remotely releasable mechanisms have allowed.

Preferably, said control means is provided in a control means housing which includes power supply means for driving said ejector means. Preferably, said power supply means is in the form of compressed pressurised hydraulic fluid contained within an accumulator bladder and said ejector is in the form of hydraulic ram in spaced apart communication with said control means whereby said control means can control the flow of pressurised hydraulic fluid from said accumulator to said spaced apart ejector means. Preferably said control means is in the form of valve means formed and arranged in a first open position to permit pressurised fluid to pass from said accumulator to said ejector means for operation thereof and in a second closed position to prevent pressurised fluid passing to said ejector means and thereby operating said ejector means for ejecting a load supported on said load supporting means. Preferably, said communication means in the form of an elongate flexible hydraulic pipe of generally known type and construction.

In its simplest form, the volume of hydraulic fluid being transferred from said accumulator to said ejector is a generally fixed volume. Preferably though, and so as to provide for a standby or redundancy eventuality in the situation where for example there is a partial loss of hydraulic fluid, the accumulator bladder is so formed and arranged with a capacity to store a plurality of charges of pressurised fluid, in the range of from two to ten charges for example five charges, each charge being sufficient to operate the ejector means once. Preferably, the charging of the accumulator is effected by a self generating power lift cylinder formed and arranged within the control means whereupon upward movement of the control means by, for example a crane, in use of the release mechanism, and lifting a load loaded onto said load supporting means causes said cylinder to stroke within the control unit and to pressurize fluid into said accumulator. Preferably, said cylinder has a full stroke in the range of from 175 mm to 230 mm and one full stroke of the cylinder is sufficient to provide a plurality of charges, for example five to seven charges, each charge being sufficient to operate said ejection means once. Desirably, a partial stroke of the cylinder, for example a stroke of 35 mm, is sufficient to provide one to two charges, each charge being sufficient to operate the ejection means once.

Preferably, there is provided a hydraulic fluid reservoir to supply fluid to be pressurised in said cylinder. Preferably, said reservoir is in the form of an annular tank surrounding said accumulator so as to reduce the overall length of the control means of the release mechanism according to the invention.

Preferably, said valve means is actuated by a solenoid type switch which is switched on and/or off by a hand held remote control transmitter using infra-red acoustic (for underwater applications) or radio signals to transmit a control signal to said control means for operation of said solenoid valve. The remote control transmitted may be of the three channel, two switch high security radio transmitter type and includes a receiver/decoder so that the receiver will decode received signals and operate only if the received signals are correct. The transmitter/receiver may be pre-set to any one of a multiplicity of separate radio frequencies and signal codes according to a user's requirements. This feature is particularly useful where several release mechanisms according to the invention are in use and it is required to operate them selectively and independently of each other. The control means is provided with an aerial/antenna to pick up and receive signals. Preferably, said receiver/decoder is arranged with an explosion proof container. Preferably, said control means is formed and arranged with an automatic reset feature whereby once the release mechanism has been actuated, and a load released, the release mechanism reverts to a ready to operate state.

As the control means of the present invention utilise preferably a solenoid type switch which requires only a small power source, there is obviated the need for large batteries or power supplies to drive hydraulic pumps as with existing known release mechanisms and the problems associated therewith. Preferably, there is provided in said control means housing a battery housing formed and arranged with a removable cover to facilitate recharging or replacement of a battery contained therein.

Preferably, said load supporting means is in the form of an inverted 'U' shaped hook and said ejector means is in the form of a lever formed and arranged upon actuation of the ejector means to push a cord or cable on which a load is slung to be pushed from within the hook up and out thereof for release from said hook.

Desirably, said discrete load supporting means is in the form of a release hook comprising a body portion having left and right hand sections releasably connected together and having therebetween at a lower hook portion of said body an ejection means in the form of a lever formed and arranged to move from a first substantially retracted position between said left and right hand sections to an extended ejecting position between said left and right hand sections so as to push a cord or cable on which a load is slung from within the hook up and out thereof for release from said hook. Said left and right hand sections of said body portion are preferably connected together by releasable fasteners such as bolts and located relative to each other by studs or dowels.

Preferably, and so as to reduce the overall size of the release hook, said left and right hand sections of said body portion house therein said hydraulic ram for driving said lever from said retracted position to said ejecting position. Desirably and again to reduce the overall size of the release hook, said hydraulic ram comprises a piston portion and a cylinder portion, said piston portion being mounted about a trunnion end thereof to an upper body portion of said hook and said cylinder portion being fixed to a lower portion of said ejection means, said cylinder portion moving relative to said fixed piston portion whereby in use said hydraulic ram, with said ejector means in said retracted position, starts from an extended length and retracts under the action of pressurised hydraulic fluid acting on the underside of said piston to an extended position, so as to drive said cylinder portion with respect thereto and thereby to drive said ejector means from said retracted position to said ejecting position.

Desirably, said release hook is releasably connected to said elongate link means by means of a shackle, preferably a bow or 'D' shackle.

Preferably, said lower hook portion of said left and right hand sections of said release hook have a surface profile formed and arranged to compliment the surface profile of a shackle loop supporting a load to be lifted by said discrete load supporting means whereby in use the load exerted on said lower hook portion of said left and right hand sections is generally evenly distributed therebetween even when the load is exerting an offset load such as that found, for example, when lifting elongate loads such as pipework.

Preferably, where it is required to lift very long elongate loads such as, for example, offshore pipework, there is provided a second discrete load supporting means provided with an ejection means, said second load supporting means being spaced apart from the other load supporting means and releasbly mounted on a boom member, desirably an extensible boom member. Desirably, said communication means is formed and arranged to connect together said control means and said two spaced apart load supporting means. Where it is required to lift very large loads, there may be provided three or more load supporting means releasably mounted on, for example, a triangular or rectangular frame, all of said load supporting means being connected to said control means whereby an operator can selectively eject a said load supported by said three or more load support means.

Preferably, said elongate support link connecting said load supporting means and said control means is in the form of a more or less substantial flexible steel cable or rope or interlinked chain. Said elongate support link may be of any length depending on the particular application but has a length in the range of from 1 m to 5 m, preferably 3 m, so as to keep the control means portion of the release mechanism a safe distance away from an operator. Said elongate support link may be provided with tensile stress measuring means such as a potentiometer formed and arranged with said control means so that in the event of a load that is too heavy for the crane in use of the release mechanism to lift safely, the release mechanism may be actuated and/or audible and/or visual alarm means actuated.

Said control means is provided with coupling means formed and arranged for coupling with said elongate support link. Preferably, said coupling means is in the form of a shackle, desirably a 'D'-shaped shackle connected to a connecting rod which is connected to a piston of said control means hydraulic ram. Desirably said connecting rod extends outwardly of the control means housing and is mounted in guides, for example bearing flats, formed and arranged to prevent rotation of said connecting rod and a load connected thereto via said load supporting means with respect to said control means housing. Desirably, said control means housing comprises a plurality of desirably cylindrical sections screwably connected together so as to facilitate manufacture, assembly/disassembly and repair of the control means. Preferably, said desirably cylindrical sections are provided with anti-rotation locking screws to prevent said sections of said housing unscrewing in use.

Further preferred features and advantages of the present invention will appear from the following detailed description given by way of example of some preferred embodiments illustrated with reference to the accompanying drawings in which.

Figure 2:
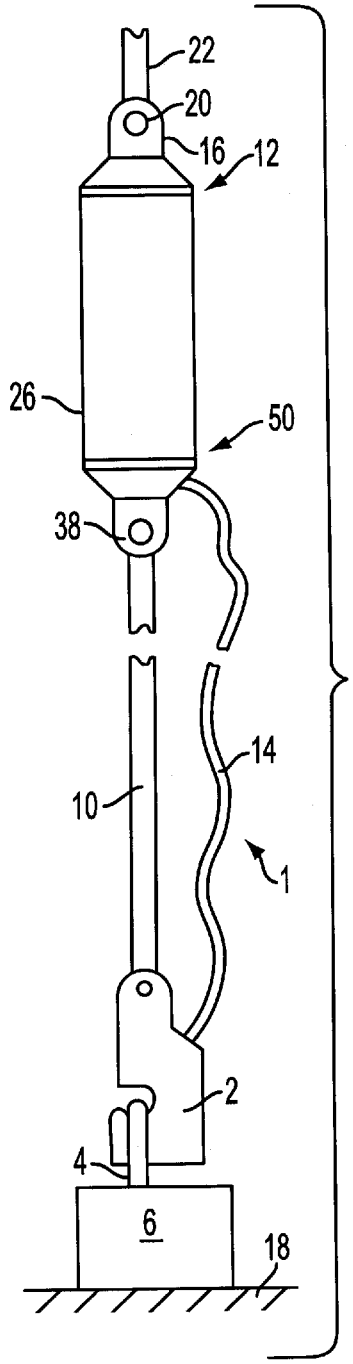
FIG. 2 shows the release mechanism in use on a crane hook supporting a load.

A release mechanism, generally indicated by reference number 1, for use in supporting a load from a crane (not shown) is shown in FIG. 2. The release mechanism comprises a remotely operable releasable hook 2 for supporting by a cable 4 a load 6. The hook 2 is provided with an ejector lever 8 (see also FIG. 3—which is shown in larger scale for improved clarity) for releasing the cable from the hook 6 upon actuation of the ejector lever 8. Connected above the hook 2 by a three meter long cable link 10 is a control unit 12 arranged for controlling the ejector lever 8 on the hook 2. The control unit 12 and the ejector lever 8 are connected together by a communication cable 14, which in the case of the embodiment described is an hydraulic cable. The top portion 16 of the control unit 12 is secured through a clevis pin 20 to a crane cable 22.

In use, an operator (not shown) would connect the cable 4 of a load 6 onto the hook 2 with the control unit 12 above and a safe distance away from the operator. When the load is secured, the crane can be operated in the generally known way so as to lift the load 6 clear of the ground 18 such that the load can be moved to a new position. Once the load is lowered into its new position, an operator (who could be the crane operator) can by using a hand held remote radio transmitter unit 24 instruct the control unit 12 to operate the ejector lever 8 on the hook 2 so as to release the load support cable from the hook 2.

The control unit 12 comprises a control unit housing 26 for containing in an intrinsically safe environment the control elements of the control unit 12 which will now be described with reference to the schematic layout shown in FIG. 1.

The control unit housing 26 contains an hydraulic fluid reservoir 28 connected on one side through a non-return valve 30 to a cylinder 32 containing a spring 34 biased piston 36. The lower end 38 of this piston 36 is connected to the link cable 10 (see also FIG. 2) from which depends the hook and the load (shown by arrow 'A'). The cylinder 32 is connected hydraulically through a further non-return valve 40 to a bladder accumulator 42 which is in turn connected to a solenoid operable valve 44 which is switchable between the communication cable 14 conduit connected to an hydraulic ram 46 on the ejector lever 8 of the hook 2 and, by another conduit 48, the reservoir 28.

In use, when a load 6 is lifted, the first piston 36 contained in the lower end 50 of the control unit 12 is pulled downwards within the cylinder 32 compressing the spring 34 and forcing hydraulic fluid into the accumulator 42 where it is stored under pressure during the period of operation of the lift. The non-return valve 30 prevents fluid going into the reservoir 28. Once the load has been placed in the required position, an operator holding the hand held transmitter unit 24 sends a radio signal 52 to the control unit 12 where it is received by an antenna 54. This signal 52 is processed by a processor unit (not shown) which causes the solenoid valve 44 to operate so that the pressurised hydraulic fluid stored in the accumulator 42 passes along the communication cable 14 into the hydraulic ram 46 connected to the ejector lever 8 on the hook 2. This pressurised fluid causes the hydraulic ram to extend (in the direction of arrow 'B'—FIGS. 2 and 3) and thereby to push the cable 4 off the hook 2 disengaging the load 6.

As there is now no load applied to the control unit 12, the piston spring 34 in the control unit cylinder 32 expands and draws fluid from the reservoir 28 through the non-return valve 30 and thereby primes itself ready for the next lift.

At the same time, the operator will have sent a second signal 52 to the control unit 12 operating the solenoid so that fluid in the hydraulic ram 46 on the hook 2 is returned to the reservoir 28. The hydraulic ram 46 includes a biasing spring 56 so that as the ejector lever 8 retracts into the hook 2 it forces fluid back into the reservoir. The hook 2 and the release mechanism 1 are then in a primed condition ready for the next lift.

The link piston 36/cylinder 32 is provided with a safety cutout switch so as to avoid "over-weight" loads being lifted.

The control unit has a length of approximately 2.5 meter, an outside diameter of ¼ m (250 mm) and a weight of 200 kg.

A second preferred embodiment of release mechanism according to the invention is shown in FIGS. 4 to 8 and will be described with like reference numbers to those used above to describe the embodiment shown in FIGS. 1 to 3.

The release mechanism, generally indicated also by reference number 1, is for use in loading, lifting and unloading a load (not shown) from a crane (not shown). The release mechanism 1 comprises a remotely operable hook 2 for supporting by a load hook shackle 4 (shown in broken line) a load (not shown). The hook 2 is provided with an ejector lever 8 (see also FIG. 6—which is shown in larger scale for improved clarity) for releasing the cable from the hook 6 upon actuation of the ejector lever 8. Connected above the hook 2 by a 3 m long cable link 10 is a control unit 12 (shown partially) arranged for controlling the ejector lever on the hook 2. The control unit 12 and the ejector lever 8 are connected together by a communication cable 14, which in the case of the embodiment described is a hydraulic cable. The top portion 16 of the control unit 12 is secured through a clevis pin 20 to a crane (not shown).

Figure 1:
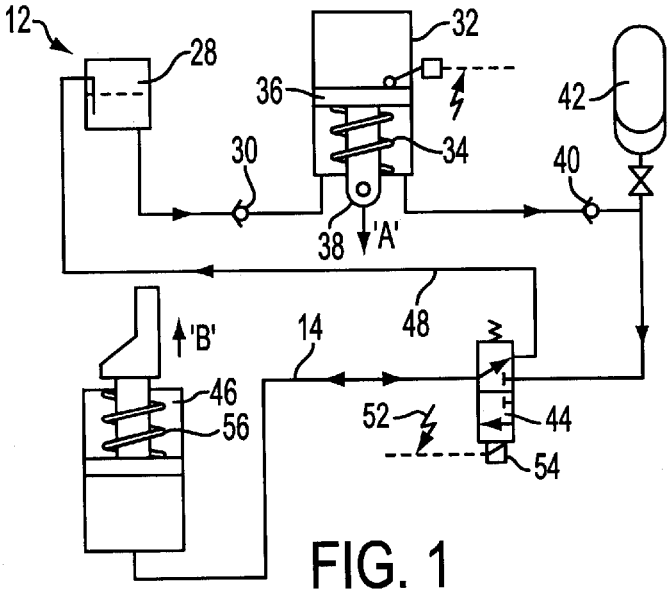
FIG. 1 is a schematic layout of the control means circuitry of the release mechanism according to the invention.
Figure 3:
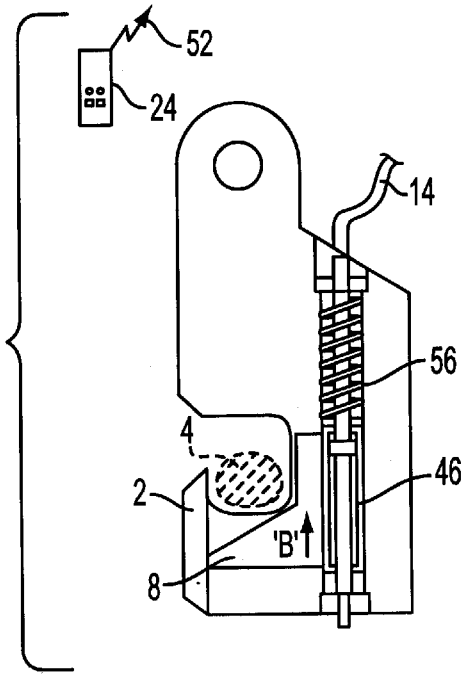
FIG. 3 shows a cutaway side view of the hook part of the release mechanism.
Figure 4:
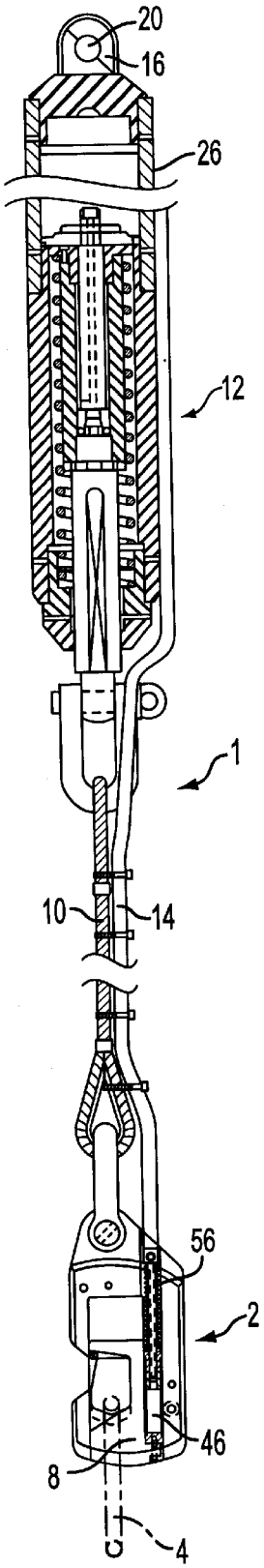
FIG. 4 is a sectional side view of a second embodiment of release mechanism according to the invention.

The mode of operation of the release mechanism 1 is as described above with reference to the first embodiment shown in FIGS. 1 to 3.

Figure 5:
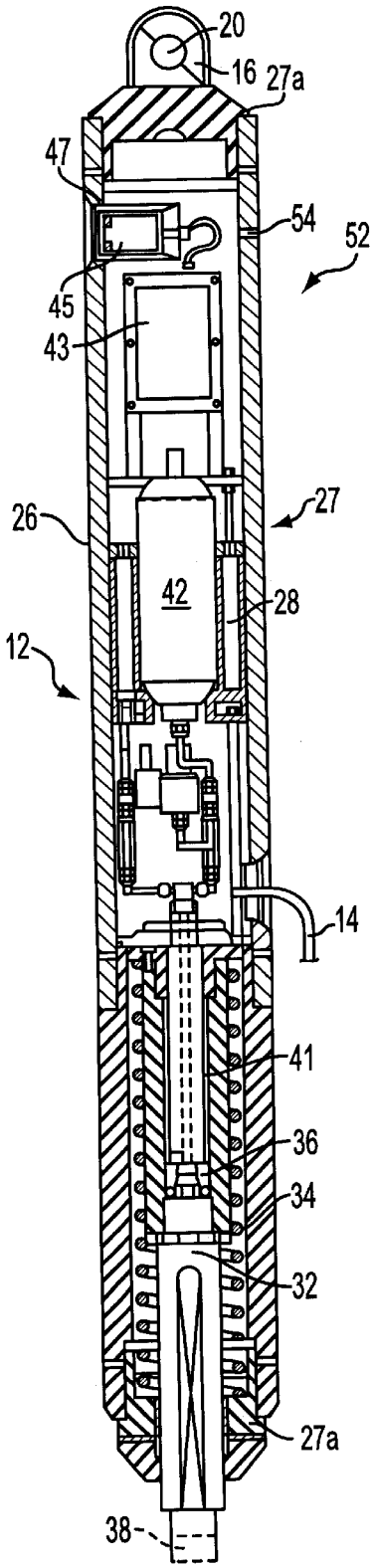
FIG. 5 is a sectional side view of a control unit of the embodiment in FIG. 4.
Figure 8:
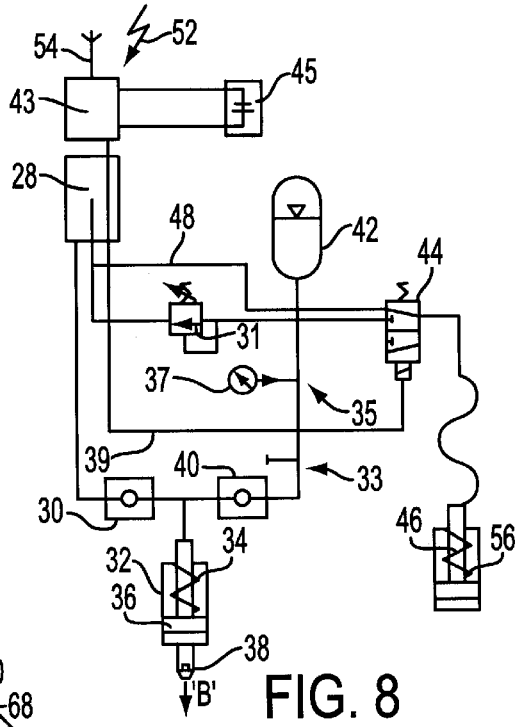
FIG. 8 is a schematic layout of the control means of the release mechanism shown in FIGS. 4–7.

The control unit 12 comprises a control unit housing 26 for containing in an intrinsically safe environment the control elements of the control unit 12 which will now be described with the reference to the schematic layout shown in FIG. 8 and with reference also to the cut-away side section of the control unit 12 shown in FIG. 5.

The control unit housing 26, which comprises an elongate cylindrical vessel 27 with end caps 27*a,* contains an hydraulic fluid reservoir 28 which has an annular form and which is connected on one side through non-return valve 30 to a cylinder 32 containing a spring 34 biased piston 36. The lower end 38 of this piston 36 is connection to the link cable 10 (see also FIG. 4) from which depends the hook and a load (shown by arrow "B"). The cylinder is connected hydraulically through a further non-return valve 40 to a bladder accumulator 42 which is in turn connected to a solenoid operable valve 44 which is switchable between the communication cable 14 conduit connected to an hydraulic ram 46 on the ejector lever of the hook 2 and, by another conduit 48, to the reservoir 28, which surrounds the bladder accumulator 42.

The accumulator 42 has a total capacity of 2.5 liters and is pre-charged to 225 psi/1550 kN/m$^2$, the reservoir is half filled and has a capacity of 2.5 liters. A relief valve 31 is provided between the solenoid valve and the reservoir and is set at 500 psi/3447 kN/m$^2$. The hydraulic circuitry is also provided with a bleed fitting 33 and a fitting 35 for connection to a test gauge 37.

The solenoid valve 44 is connected by an electrical cable 39 to an electronic control box 43 which is connected electrically to a battery 45 contained in a sealed battery container 47. The battery has a 12 volt dc power supply.

In use, when a load (not shown) is lifted, the first piston 36 contained in the lower end of the control unit 12 is pulled downwards within the cylinder 32 compressing the spring 34 and forcing hydraulic fluid 41 into the accumulator 42 where it is stored under pressure during the period of operation of the lifting of the load. The non-return valve 30 prevents fluid 41 going into the reservoir 28. Once the load has been placed in the required position, an operator holding a hand held transmitter (not shown) sends a radio signal 52 to the control unit which is received by an antenna 54, connected to the electronic control box 43. This signal 52 is processed by the processor unit which causes the solenoid valve 44 to operate so that the pressurised hydraulic fluid stored in the accumulator 42 passes along the communication cable 14 into the hydraulic ram connected to the ejector lever 8 on the hook 2 (see also FIGS. 4, 6 and 7). This pressurised fluid 41 causes the hydraulic ram 46 to pull the ejector lever 8 upwardly thereby to push the ring 4 off the hook 2 to disengage the load.

As there is now no load applied to the control unit, the piston spring 34 in the control unit cylinder 32 expands and draws fluid from the reservoir 28 through the non-return valve 30 thereby priming itself ready for the next lift. The electronic control unit is provided with an automatic reset function so as to reset the solenoid valve so that the release mechanism is ready for the next lift. The effect of this automatic reset function is such that the fluid in the hydraulic ram 46 on the hook 2 is returned to the reservoir 26. The hydraulic ram 46 on the hook (and shown in more detail in FIGS. 6 and 7) includes a biasing spring 56 so that as the ejector lever 8 retracts into the hook 2, fluid flows back into the reservoir 28.

Figure 6:
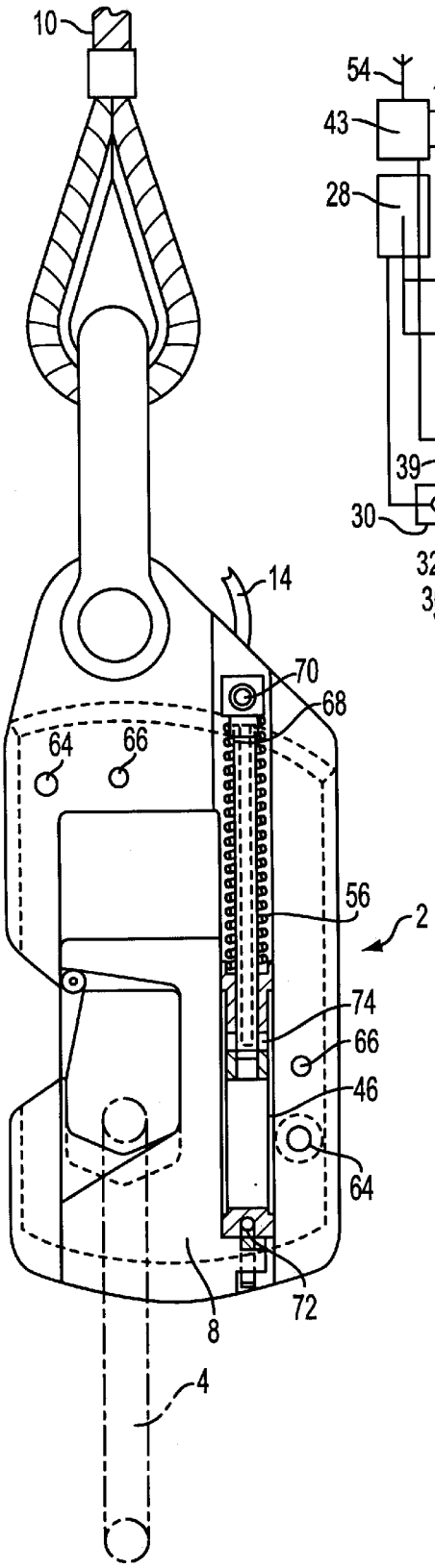
FIG. 6 is an enlarged side view of the hook part of the release mechanism shown in FIGS. 4 and 5.
Figure 7:
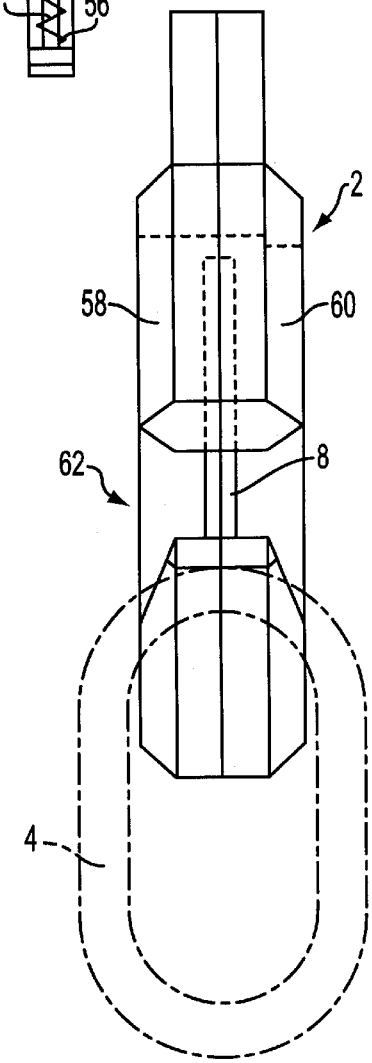
FIG. 7 is front view of the hook shown in FIG. 6.

The hook 2, shown in more detail in FIGS. 6 and 7, comprises a left hand 58 and right hand 60 portions which form the body 62 of the hook 2. The left and right hand body portions contain the hydraulic ram 46 connected to the ejection lever 8. The left and right hand body portions are connected together by bolts 64 and dowels 66. The top part 68 of the hydraulic ram 46 is fixed via a trunnion 70 to the top portion of the hook 2. The bottom portion of the ejector lever 8 is connected at 72 to the lower end cylinder portion of the hydraulic ram 46. Pressurised hydraulic fluid enters on the underside 74 of the piston portion of the hydraulic ram 46 such that the hydraulic ram 46 pushes the cylinder portion of the ram upwardly thereby drawing up the ejector lever 8 so as to disengage the ring 4 from the hook 2. It will be appreciated therefore that, instead of using a hydraulic ram which starts in a contracted state and expands into a deployed elongate state, the overall length of the hook can be substantially reduced.

As an indication, the height of the hook 2 is approximately 600 mm, the length of the control unit is approximately 2500 mm and the length of the cable link 10 is approximately 3000 mm. The hook has a safe working load of 12 tonne, the link cable a safe working load of 12 tonne and the control unit a safe working load of 25 tonne. The shackle for connecting together the control unit and cable link and the cable link to the hook have safe working loads of 13 tonne.

Various modification may be made to the above-described embodiments without departing from the scope of the present invention. Thus, for example instead of the control units being connected directly to a hook, there could be provided two spaced apart hooks mounted on either end of an extensible boom which boom is connected at a centre position to the bottom of the control unit.

What is claimed is:

1. A release mechanism (1) suitable for use in releasing remotely a load (6) supported on a hook (4) or the like which mechanism comprises a discrete load supporting means (2) provided with ejector means (8) formed and arranged for selectively ejecting a said load supported thereby and discrete control means (12) formed and arranged for controlling said ejector means (8) on said load supporting means (2), said control means (12) being provided in a control means housing (27) which housing (27) includes power supply means (42) for driving said ejector means (8), said load supporting means (2) being substantially spaced apart and depending from said control means (12) by an elongate support link (10) and said control means (12) and said ejector means (8) being connected together by a communication means (14), and a reservoir (28) to supply pressurised fluid; characterised in that said power supply means (42) is in the form of a compressed pressurised hydraulic fluid contained within an accumulator bladder (42) and said reservoir (28) is in the form of an annular tank surrounding said accumulator bladder (42).

2. A release mechanism according to claim 1 wherein said ejector is in the form of a hydraulic ram (46) in spaced apart communication with said control means (12).

3. A release mechanism according to claim 2 wherein said control means housing (27) contains an explosion proof housing for housing a control unit (43).

4. A release mechanism according to claim 1 wherein said control means is in the form of a valve means (44) formed and arranged in a first open position to permit pressurised fluid to pass from said accumulator (42) to said ejector means (8) for operation thereof and in a second closed position to prevent pressurised fluid passing to said ejector means (8).

5. A release mechanism according to claim 4 wherein said valve means is actuated between said first and second positions by a solenoid type switch (44).

6. A release mechanism according to claim 1 wherein said communication means (14) is in the form of an elongate flexible hydraulic pipe.

7. A release mechanism according to claim 1 wherein said accumulator bladder (42) is formed and arranged with the capacity to store a plurality of charges of pressurised fluid, each one of said charges of pressurised fluid being sufficient to operate said ejector means at least once.

8. A release mechanism according to claim 1 wherein the charging of the said accumulator (42) is effected by a self generating power lift cylinder (32) formed and arranged within said control means (12) whereby upward movement of the control means causes said cylinders to stroke and to pressurize hydraulic fluid into said accumulator bladder (42).

9. A release mechanism according to claim 1 wherein said control means (12) is operable remotely by a hand held control transmitter (24).

10. A release mechanism according to claim 1 wherein said load supporting means (2) is in the form of an inverted U-shaped hook and said ejector means (8) is in the form of a lever formed and arranged upon actuation of said ejector means to push a cord or cable on which a load is slung from within the hook up and out thereof for release from said hook (2).

11. A release mechanism according to claim 1 wherein said load supporting means is in the form of a release hook (2) comprising a body portion having left (58) and right (60) hand sections releasably connected together and housing therebetween at a lower hook portion said ejector means (8).

12. A release mechanism according to claim 11 wherein said ejector means is in the form of a lever (8) formed and arranged to move from a first substantially retracted position between said left (58) and right (60) hand sections to an extended ejecting position between said left and right hand sections.

13. A release mechanism according to claim 12 wherein said discrete load supporting means (2) houses an hydraulic ram (46) for driving said lever (8) from said retracted position to said ejecting position.

14. A release mechanism according to claim 11 wherein said left (58) and right (60) hand sections of said body portion are connected together by releasable fasteners (64).

15. A release mechanism according to claim 11 wherein said lower hook portion of said left (58) and right hand (60) sections of said release hook (2) have a surface profile formed and arranged to compliment the surface profile of a shackle loop (4) supporting a load (6) in use of the release mechanism.

16. A release mechanism according to claim 1 wherein there is provided a second discrete load supporting means (2) provided with ejection means (8), said second load supporting means being spaced apart from the other load supporting means and releasably mounted on a boom member.

17. A release mechanism according to claim 16 wherein said boom member is extensible.

18. A release mechanism according to claim 1 wherein there are provided three or more load supporting means (2) connected to said control means (12).

19. A release mechanism according to claim 1 wherein said elongate support link (10) connecting said load supporting means (2) and said control means (12) is in the form of a substantially flexible cable.

20. A release mechanism according to claim 1 wherein said control means housing (27) is provided with guide means formed and arranged to prevent rotation of said control means hydraulic ram (38) with respect to said control means housing (27).

* * * * *